US007185370B2

(12) United States Patent
Greear-Astaud et al.

(10) Patent No.: US 7,185,370 B2
(45) Date of Patent: Mar. 6, 2007

(54) INFANT BIB

(76) Inventors: Tonya L. Greear-Astaud, 16 Pepperdine Cir., Baltimore, MD (US) 21228; Patricia Greear, 9740 Conmar Rd., Baltimore, MD (US) 21220

( * ) Notice: Subject to any disclaimer, the term of this patent is extended or adjusted under 35 U.S.C. 154(b) by 0 days.

(21) Appl. No.: 11/416,279

(22) Filed: May 2, 2006

(65) Prior Publication Data

US 2006/0282931 A1 Dec. 21, 2006

Related U.S. Application Data

(63) Continuation-in-part of application No. 11/154,508, filed on Jun. 16, 2005, now abandoned.

(51) Int. Cl.
*A41B 13/10* (2006.01)

(52) U.S. Cl. ..... 2/49.1; 2/52

(58) Field of Classification Search ..... 2/48, 2/49.1–49.5, 50, 51, 52, 463, 109, 102, 110, 2/113, 114, 92; 450/1, 3, 80, 91, 90; D2/860–862
See application file for complete search history.

(56) References Cited

U.S. PATENT DOCUMENTS

| | | | | | |
|---|---|---|---|---|---|
| 1,389,689 | A | | 9/1921 | Parker | 2/48 |
| 1,391,121 | A | | 9/1921 | Kepel | |
| D104,490 | S | | 5/1937 | Anderson | D2/864 |
| 2,235,353 | A | * | 3/1941 | Beede | 2/52 |
| 2,299,232 | A | | 10/1942 | Heyser | 2/49.1 |
| 2,426,565 | A | * | 8/1947 | Quinn | 2/52 |
| 2,452,038 | A | | 10/1948 | Mink | 2/48 |
| 2,456,552 | A | * | 12/1948 | Wittner | 450/90 |
| 2,518,357 | A | | 8/1950 | Miles | 2/49.3 |
| 4,127,135 | A | | 11/1978 | Stern | 450/1 |
| 4,393,875 | A | | 7/1983 | O'Boyle et al. | 450/1 |
| 4,441,025 | A | | 4/1984 | McCoy | 250/516.1 |
| 4,569,086 | A | | 2/1986 | Takefman | 2/49 |
| 4,663,779 | A | | 5/1987 | Bible | 2/49 |
| 4,884,298 | A | | 12/1989 | Silas | 2/48 |
| 5,184,351 | A | | 2/1993 | Benstock | 2/114 |
| 5,682,609 | A | | 11/1997 | Ayo | 2/49.2 |

(Continued)

*Primary Examiner*—A. Vanatta
(74) *Attorney, Agent, or Firm*—Larry J. Guffey

(57) ABSTRACT

The present invention introduces improved protective garments, especially in the form of safer infant bibs. An improved infant bib includes: (a) a central piece of material having right and left side edges of length Y, and configured so to cover the frontal area of an infant's trunk, (b) a pair of shoulder extensions, each of which extends from proximate a top edge corner of the central piece, (c) a pair of underarm extensions, each of which extends from a central piece side edge and are configured so as to form an underarm strap that extends around the side of the trunk of an infant and under it's arm, (d) wherein each of the shoulder extensions' end edges being fastened to the underarm extension that extends from the same side of the central piece, and wherein the length of this underarm extension from its point of attachment to the central piece to its point of attachment with the shoulder extension end edge has a magnitude of X, and (e) wherein in order to provide the bib with sufficient three-dimensional shape and desired fitting characteristics, the ratio of the specified lengths, X/Y, is chosen to have a value less than one and as dictated by the shape of the torso of the infant wearer.

20 Claims, 3 Drawing Sheets

U.S. PATENT DOCUMENTS

| | | | | |
|---|---|---|---|---|
| 5,822,792 | A | 10/1998 | Reinhart | 2/49.1 |
| 5,881,382 | A | 3/1999 | Bernard et al. | 2/49.1 |
| D416,663 | S | 11/1999 | Thomas | D2/861 |
| D432,759 | S | 10/2000 | Krolczyk et al. | D2/864 |
| 6,282,716 | B1 | 9/2001 | Patterson et al. | 2/49.1 |
| 6,645,040 | B2 | 11/2003 | Rabinowicz | 450/1 |
| 6,732,375 | B2 | 5/2004 | Nornes | 2/49.1 |
| 6,799,330 | B1 | 10/2004 | Lansdell | 2/49.1 |
| 6,859,938 | B1 | 3/2005 | Niski et al. | 2/49.1 |
| 2003/0163861 | A1 | 9/2003 | Avrahami | 2/69 |

* cited by examiner

INFANT BIB

CROSS-REFERENCE TO RELATED APPLICATION

This application claims the benefit of U.S. patent application Ser. No. 11/154,508, filed Jun. 16, 2005 now abandoned, by the present inventors. The present filing is a continuation-in-part application of this earlier filing and incorporates its teachings by reference to the extent that they do not conflict with the teaching herein.

BACKGROUND OF THE INVENTION

1. Field of the Invention

The present invention generally relates to apparel. More particularly, this invention relates to protective garments in the form of an improved infant bib.

2. Description of the Related Art

Protective garments such as infant bibs are used on most infants and children to protect their bodies and clothing from dribbled and spilled liquids and other food-stuff materials. Many bibs use absorbent materials, such as terrycloth, while others use impermeable materials that repel liquids and food instead of absorbing them. Some bibs are reusable, like clothing, and can be washed in a washing machine while others are made of plastics and can be wiped with a cloth. Others are disposable and are meant for single use.

Various bib configurations have been developed to place and secure the bib to a wearer, such as an infant. While there are many configurations for securing a bib to an infant, they can all be placed into two general categories.

The first category includes bibs with two arm-like appendages which wrap around the infant's neck and attach/secure behind the infant's neck using fasteners such as buttons, strings, snaps, tape or hook and loop fasteners sold under the trademark VELCRO.

The second category includes bibs having an opening within the body of the bib so that the bib can slide down over the infant's head. The opening may be a circular hole cut into the bib, or else comprise a cutout employing a neck band to hang the bib around an infant's neck.

It is our observation that these two general bib configurations present significant disadvantages that has heretofore not been recognized. Since both of the configurations entail something wrapping only around an infant's neck, they both create a possibly dangerous situation in which any loading or downward force that is applied to the bib is transferred and concentrated onto an infant's neck—a part of the infant's anatomy that is least likely to be able to tolerate a significant loading or blow to it (e.g., if a portion of a bib were to become entangled in a highchair joint when an infant leans forward; then, if the infant leans back quickly and the bib does not move or stretch, the infant causes itself to potentially take a severe and injurious blow to the. back of its neck).

Additionally, the fact that most portions of such prior art bibs can easily be moved away from an infant's torso means that such portions are at a greater risk of being ensnared or caught in or on some nearby object. Such situations may quickly present a choking hazard for the infant due to the infant's movement or the movement of the object on which the bib is caught.

Therefore, a need exists for a safer bib which does not create situations that potentially expose an infant to neck injuries or choking hazards.

Objects and Advantages

There has been summarized above, rather broadly, the prior art that is related to the present invention in order that the context of the present invention may be better understood and appreciated. In this regard, it is instructive to also consider the objects and advantages of the present invention.

It is an object of the present invention to provide a protective garment or bib that can be worn without exposing its wearer to potential neck injuries or choking hazards.

It is another object of the present invention to provide a protective garment or bib that is safer for one to wear than the existing garments in the marketplace.

It is a further object of the present invention to provide a protective garment or bib that is more comfortable for one to wear than the existing garments in the marketplace.

These and other objects and advantages of the present invention will become readily apparent as the invention is better understood by reference to the accompanying summary, drawings and the detailed description that follows.

SUMMARY OF THE INVENTION

Recognizing the need for the development and creation of improved (e.g., safer and more comfortable to wear) protective garments of the type that fit behind a wearer's neck, the present invention is generally directed to satisfying the needs set forth above and overcoming the disadvantages identified with prior art garments and the manner in which they are configured.

In accordance with the present invention, the foregoing need can be satisfied by providing improved protective garments, especially in the form of safer infant bibs. An improved infant bib includes: (a) a central piece of material having top, bottom, right and left side edges, with the side edges have a length of Y, and configured so to cover the frontal area of a wearer's trunk, (b) a pair of shoulder extensions, each of them extending from proximate one the material's top edge corner, with these shoulder extensions configured so as to form wide straps that extend over the top portion of a wearer's shoulders, each of these shoulder extension terminating in an end edge, (c) a pair of underarm extensions, each of these underarm extensions extending from one of the material's side edge and configured so as to form an underarm strap that extends around the side of the trunk of a wearer and under a wearer's arm, each of these underarm extensions terminating in an end edge, (d) wherein each of the shoulder extension end edges being fastened to the underarm extension that extends from the same side of the material at a point that is proximate the underarm extension end edge so as to form in the bib an armpit for each of a wearer's arms, and with the length of this underarm extension from its point of attachment to the central piece to its point of attachment with the shoulder extension end edge being of magnitude X, (e) a pair of hook and loop fasteners, with one being attached proximate to each of the underarm extension end edges, (f) wherein in order to provide the bib with sufficient three-dimensional shape and desired fitting characteristics, the ratio of the specified lengths, X/Y, is chosen to have a value less than one and as dictated by the shape of the torso of the infant wearer, a preferred value being in the range of 40% to 60% and (g) wherein the shoulder and underarm extensions are further configured so as to allow the fasteners to be fastened at a location that is situated approximately in the middle of the infant's back.

Thus, there has been summarized above, rather broadly, the present invention in order that the detailed description that follows may be better understood and appreciated. There are, of course, additional features of the invention that will be described hereinafter and which will form the subject matter of the claims to this invention.

DESCRIPTION OF THE PREFERRED EMBODIMENT

Figure 1:
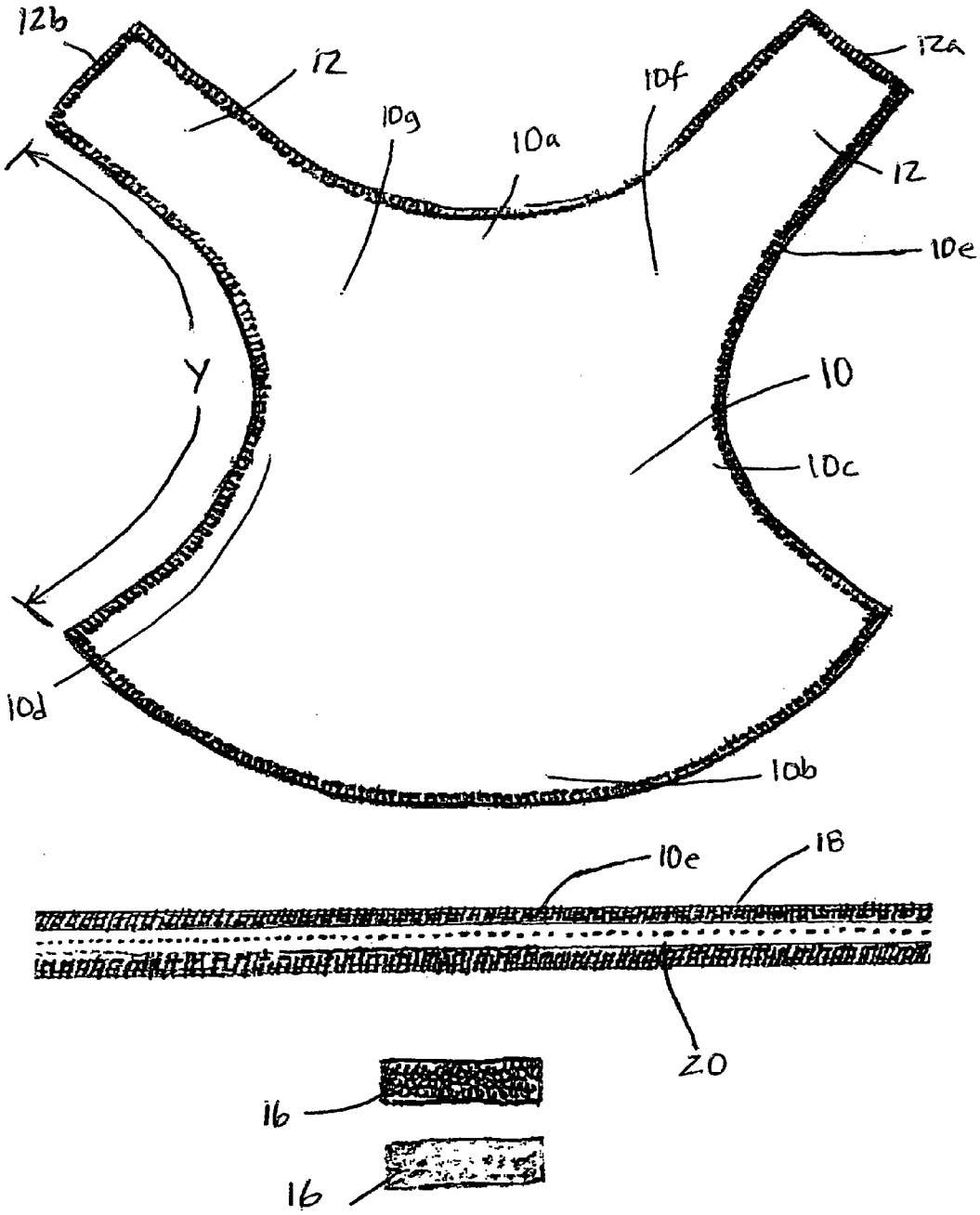
FIG. 1 shows the basic components that are brought together to form the improved bib of the present invention.

Before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

FIG. 1 shows the basic components that are brought together to form the improved bib 2 of the present invention. As shown in FIG. 1, these components are already at a stage where a considerable amount of work has been expended to bring to the point where they are ready to be joined together. These components include a central piece 10 whose shape, with its top 10*a*, bottom 10*b*, right 10*c* and left 10*d* side edges, has been configured so to cover an infant's frontal area. This piece is actually of a two-ply construction (e.g., a 100% cotton terrycloth upper and a bottom layer of 100% cotton jersey knit; both of which have been prewashed to prevent shrinkage) whose edges are bound with a ¼ inch double overlock stitch 10*e* using polyester thread so that it can withstand washer/dryer conditions.

Figure 2:
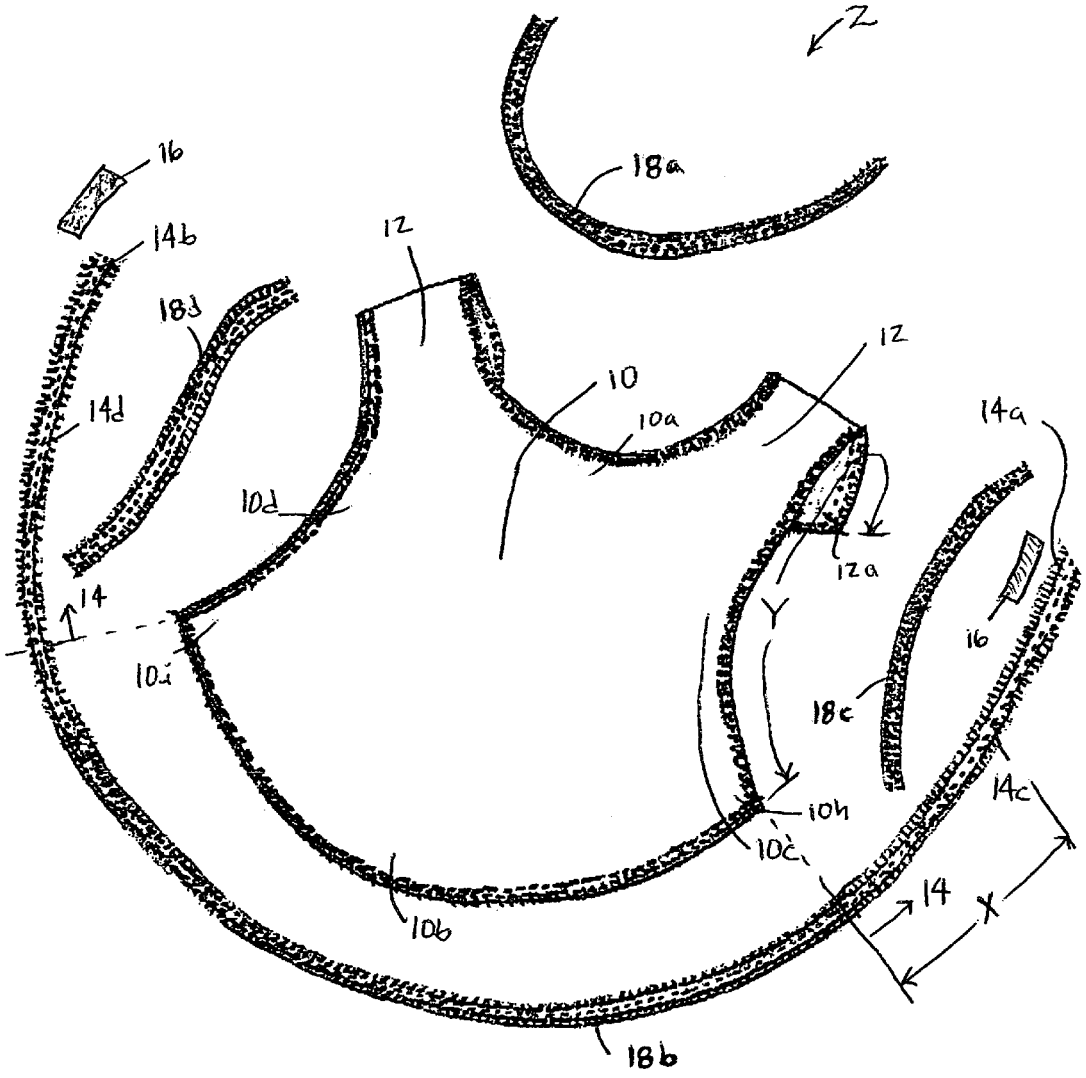
FIG. 2 shows these same components once the trim material has been cut into four pieces or strips of specified length and brought into proximity to the edges to which they will be attached and the central piece has been partially folded to reflect the three-dimensional shape that it will take when the bib is fully fabricated.

Also shown at the bottom of the page is a representative strip of trim or reinforcing material 18 that is cut to appropriate lengths, see FIG. 2, and added to the edges of the central piece 10. The longest of these cut lengths, and that which is added to the central piece's bottom edge, is also given some additional length so that its ends can be used to form underarm extensions 14 that give this bib 2 its ultimate unique shape. A pair of hook and loop fasteners 16, or other suitable fastening means (e.g., buttons, strings, straps, tape or hook), are added to the opposite ends of these extensions 14.

The strip of trim or reinforcing material 18 is of the same two-ply construction as the central piece and it additionally has, for decorative purposes, a strip of decorative ribbon 20 that runs down the center of this trim material and is attached with a single, straight stitch using polyester thread.

FIG. 2 shows these same components once the trim material 18 has been cut into four pieces or strips 18*a–d* of specified length and brought into proximity to the edges 10*a–b* to which they will be attached. It should also be noted in FIG. 2 that the central piece 10 has been partially folded to reflect the three-dimensional shape that it will take when the bib is fully fabricated. This folding and shaping of the material 10 is essential to yielding a bib that can fit closely and comfortable around an infant's neck, arms and torso.

Figure 3:
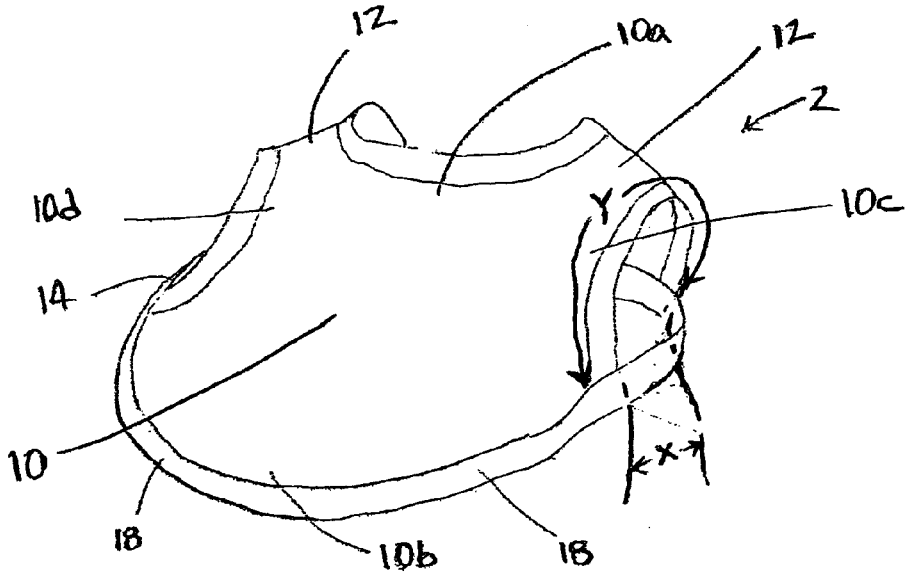
FIG. 3 shows a front perspective view of a preferred embodiment of the present invention in the form of an improved and safer infant bib.
Figure 4:
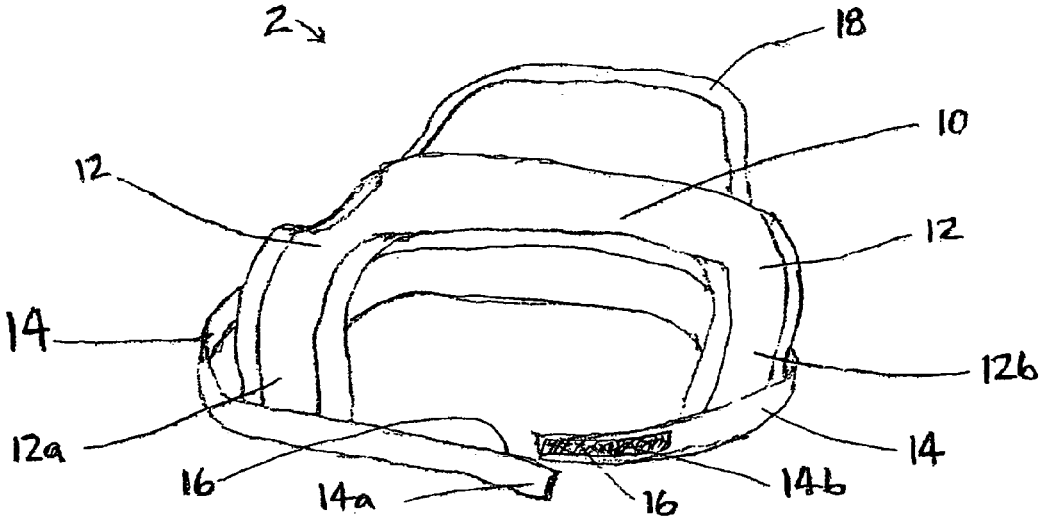
FIG. 4 shows a rear perspective view of the bib shown in FIG. 3.

FIGS. 3 and 4 show, respectively, a front and rear perspective view of a preferred embodiment of this fully assembled, improved and safer infant bib 2. This central part can be seen to have a pair of unique shoulder extensions 12 that are contiguous with the central part and extend from proximate each of this central part's top right 10*f* and left 10*g* edge corners. These shoulder extensions are of a specified width and configured so as to form wide straps which allow any downward load placed on the garment to be approximately distributed over approximately the entire shoulder tops of a wearer. These straps extend over the top portion of an infant's shoulders and their terminal end edges 12*a*, 12*b* extend down each side of an infant's back rather than being drawn together behind an infant's neck.

The pair of underarm extensions 14 is configured so as to form an underarm strap that extends around the side of the trunk of an infant and under the infant's arm. Each of these underarm extensions has a terminating end edge 14*a*, 14*b* to which the fastening means 16 are attached. The underarm 14 and shoulder 12 extensions are especially configured so as to allow for a mid-back closure of the bib (i.e., approximately in the middle of the infant's back).

The shoulder extension end edges 12*a*, 12*b* are seen to be fastened to a portion of the underarm extension that extends from the same side of the central part 10 at points that are somewhat near the end edge 14*a*, 14*b* of the underarm extension so as to form an armpit for each of an infant's arms. Just how close these points are to the underarm extension end edges 14*a*, 14*b* will usually be determined by the length of the fastening means 16 (e.g., in a preferred embodiment for an infant, two inch VELCRO strips on either end of the underarm extensions) and how much adjustability it is desired to incorporate into this mid-back closure of the bib.

The length of the underarm extensions 14 are chosen so that the fasteners can be connected over a range of connection points so that this bib can be comfortably fitted onto an infant. To accommodate infants of different trunk and arm sizes, the size of the central piece and the shoulder and underarm extensions are scaled accordingly.

The design of the bib is such that the bib's connection point is at the mid point of an infant's back rather than behind an infant's neck, the location where the connection point of most bibs is found.

It should be noted that the present design calls for the length of the distance, denoted as X in FIGS. 2 and 3, between the points 10*h*, 10*i* where an underarm extension 14 leaves the bottom corners of the central piece and the points 14*c*, 14*d* where it is fixedly connected to a shoulder extension end edge 12*a*, 12*b* is less than the length Y of adjoining edge that help to form the opening for an infant's arm, see FIGS. 1–3. The length Y can be seen to be the sum of either of the lengths of the central part side edges and the length of the adjoining shoulder extension.

Control of this ratio X/Y allows one to affect how much permanent or ever-present pucker or three-dimensional shape that this bib will have, and consequently how snuggly and comfortably this bib will fit around an infant's torso. Ranges of X/Y of 40% to 60% have been found to provide the bib with a suitable three-dimensional shape.

For an infant, this degree of this fit is important for other reasons than just snugness and comfort—an infant's safety can be jeopardized when the edges of a loose fitting bib can get caught in nearby cracks and create possible strangulation threats for an infant as he/she struggles to undo an entrapped edge.

Additionally, this novel and safer configuration for an infant's bib 2 can be recognized to enable any downward load placed on the central part of the bib to be distributed, by the shoulder extensions 12 and the manner in which they connect to the underarm extensions 14, over the tops of an infant's shoulders, rather than being concentrated on an area behind an infant's neck, so as to absorb in a less threatening and dangerous manner any downward load that may be placed on the bib.

As previously noted, materials suitable for use in constructing such an infant bib include absorbent materials, such as terrycloth, and also impermeable materials, such as plastics, that repel liquids and food instead of absorbing them. When shrinkable materials are being used, it has been found advisable to pre-wash such materials before beginning to craft them into the form of the bib disclosed herein.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention as hereinafter set forth in the claims.

We claim:

1. An improved protective garment that is to be worn about a wearer's neck and shoulders, said garment comprising:

a central piece of material having top, bottom, right and left side edges and configured so to cover approximately the entire trunk frontal area of said wearer, wherein said right and left side edges having a specified length, a pair of shoulder extensions, each of said shoulder extensions having a specified length and extending proximate each said central piece of material top edge corner, each said shoulder extension configured so as to form a strap that extends over the top portion of one of the shoulders of said wearer, each said shoulder extension terminating in an end edge, wherein the sum of said specified length of either of said central piece side edges and the length of said adjoining shoulder extension being denoted herein as Y, a pair of underarm extensions, each of said underarm extensions extending from one of said central piece of material side bottom corner edges and configured so as to form an underarm strap that extends around the side of the trunk of a wearer and under one of the arms of said wearer, each said underarm extensions terminating in an end edge, wherein each of said shoulder extension end edges being fastened to the underarm extension that extends from the same side of said material at a point that is proximate said underarm end edge so as to form an armpit for each of the arms of said wearer, wherein the length of each of said underarm extensions from the point of attachment with said central piece to the point of attachment with said shoulder extension end edge being of a specified value, denoted as X, wherein in order to provide said garment with permanent three-dimensional shape and desired fitting characteristics, the ratio of said lengths, X/Y, is chosen to have a value less than one and as dictated by the shape of the torso of said wearer, a pair of fastening means, with one of said means being attached proximate to one of each said underarm extension end edges, and wherein said shoulder and underarm extensions being further configured so as to allow said fastening means to be fastened at a location that is situated approximately in the middle of the back of said wearer.

2. The improved garment as recited in claim 1, wherein said shoulder extensions having a specified width that is of a magnitude such as to cause any downward load placed on said garment to be approximately distributed over the entire shoulder tops of a wearer.

3. The improved garment as recited in claim 1, wherein said elements of said garment being further configured so as to allow said garment to be especially suited for use as an infant bib.

4. The improved garment as recited in claim 2, wherein said elements of said garment being further configured so as to allow said garment to be especially suited for use as an infant bib.

5. The improved garment as recited in claim 3, wherein the ratio of said lengths, X/Y, being in the range of 40% to 60%.

6. The improved garment as recited in claim 4, wherein the ratio of said lengths, X/Y, being in the range of 40% to 60%.

7. The improved garment as recited in claim 1, further comprising strips of reinforcing material being placed proximate select of said garment edges, said strips configured and selected from a material chosen so as to serve the purpose chosen from the group of adding weight or cushioning to the edges of said garment.

8. The improved garment as recited in claim 2, further comprising strips of reinforcing material being placed proximate select of said garment edges, said strips configured and selected from a material chosen so as to serve the purpose chosen from the group of adding weight or cushioning to the edges of said garment.

9. The improved garment as recited in claim 3, further comprising strips of reinforcing material being placed proximate select of said garment edges, said strips configured and selected from a material chosen so as to serve the purpose chosen from the group of adding weight or cushioning to the edges of said garment.

10. The improved garment as recited in claim 5, further comprising strips of reinforcing material being placed proximate select of said garment edges, said strips configured and selected from a material chosen so as to serve the purpose chosen from the group of adding weight or cushioning to the edges of said garment.

11. An improved method of constructing a protective garment that is to be worn about a wearer's neck and shoulders, said method comprising the steps of:

using a central piece of material having top, bottom, right and left side edges and configured so to cover approximately the entire trunk frontal area of said wearer, wherein said right and left side edges having a specified length, using a pair of shoulder extensions, each of said shoulder extensions having a specified length and extending from proximate each said central piece of material top edge corner, each said shoulder extension configured so as to form a strap that extends over the top portion of one of the shoulders of said wearer, each said shoulder extension terminating in an end edge, wherein the sum of said specified length of either of said central piece side edges and the length of said adjoining shoulder extension being denoted herein as Y, using a pair of underarm extensions, each of said underarm extensions extending from one of said central piece of material side bottom corner edges and configured so as to form an underarm strap that extends around the side of the trunk of a wearer and under one of the arms of said wearer, each said underarm extensions terminating in an end edge, wherein each of said shoulder extension end edges being fastened to the underarm extension that extends from the same side of said material at a point that is proximate said underarm end edge so as to form an armpit for each of the arms of said wearer, wherein the length of each of said underarm extensions from the point of attachment with said central piece to the point of attachment with said shoulder extension end edge being of a specified value, denoted as X, wherein in order to provide said garment with permanent three-dimensional shape and desired fitting characteristics, the ratio of said lengths, X/Y, is chosen to have a value less than one and as dictated by the shape of the torso of said wearer, using a pair of fastening means, with one of said means being attached proximate to one of each said underarm extension end edges, and wherein said shoulder and underarm extensions being further configured so as to allow said fastening means to be fastened at a location that is situated approximately in the middle of the back of said wearer.

12. The improved method as recited in claim 11, further comprising the step of configuring said shoulder extensions having a specified width that is of a magnitude such as to cause any downward load placed on said garment to be approximately distributed over the entire shoulder tops of a wearer.

13. The improved method as recited in claim 11, further comprising the step of configuring said elements of said garment so as to allow said garment to be especially suited for use as an infant bib.

14. The improved method as recited in claim 12, further comprising the step of configuring said elements of said garment so as to allow said garment to be especially suited for use as an infant bib.

15. The improved method as recited in claim 13, further comprising the step of configuring said lengths of said right and left side edges and said length of each of said underarm extensions from the point of attachment with said central piece to the point of attachment with said shoulder extension end edge so that the ratio of said lengths, X/Y, is in the range of 40% to 60%.

16. The improved method as recited in claim 14, further comprising the step of configuring said lengths of said right and left side edges and said length of each of said underarm extensions from the point of attachment with said central piece to the point of attachment with said shoulder extension end edge so that the ratio of said lengths, X/Y, is in the range of 40% to 60%.

17. The improved method as recited in claim 11, further comprising the step of placing strips of reinforcing material proximate select of said garment edges, said strips configured and selected from a material chosen so as to serve the purpose chosen from the group of adding weight or cushioning to the edges of said garment.

18. The improved method as recited in claim 12, further comprising the step of placing strips of reinforcing material proximate select of said garment edges, said strips configured and selected from a material chosen so as to serve the purpose chosen from the group of adding weight or cushioning to the edges of said garment.

19. The improved method as recited in claim 13, further comprising the step of placing strips of reinforcing material proximate select of said garment edges, said strips configured and selected from a material chosen so as to serve the purpose chosen from the group of adding weight or cushioning to the edges of said garment.

20. The improved method as recited in claim 15, further comprising the step of placing strips of reinforcing material proximate select of said garment edges, said strips configured and selected from a material chosen so as to serve the purpose chosen from the group of adding weight or cushioning to the edges of said garment.

* * * * *